US009662529B2

(12) United States Patent
Miller

(10) Patent No.: US 9,662,529 B2
(45) Date of Patent: May 30, 2017

(54) EXERCISE APPARATUS WITH A USER CONTROLLED, GRAVITY OPERATED SHIFTING MECHANISM

(71) Applicant: Bart Miller, Littleton, CO (US)

(72) Inventor: Bart Miller, Littleton, CO (US)

( * ) Notice: Subject to any disclaimer, the term of this patent is extended or adjusted under 35 U.S.C. 154(b) by 82 days.

(21) Appl. No.: 14/552,118

(22) Filed: Nov. 24, 2014

(65) Prior Publication Data

US 2015/0148200 A1 May 28, 2015

Related U.S. Application Data

(60) Provisional application No. 61/907,514, filed on Nov. 22, 2013, provisional application No. 62/074,218, filed on Nov. 3, 2014.

(51) Int. Cl.

| | |
|---|---|
| ***A63B 21/08*** | (2006.01) |
| ***A63B 21/22*** | (2006.01) |
| ***A63B 21/06*** | (2006.01) |
| ***A63B 21/062*** | (2006.01) |
| ***A63B 21/00*** | (2006.01) |
| ***A63B 23/035*** | (2006.01) |
| ***A63B 24/00*** | (2006.01) |
| *A63B 21/055* | (2006.01) |
| *A63B 71/06* | (2006.01) |

(52) U.S. Cl.

CPC .... *A63B 21/0616* (2015.10); *A63B 21/00072* (2013.01); *A63B 21/00076* (2013.01); *A63B 21/0628* (2015.10); *A63B 21/4047* (2015.10); *A63B 23/03516* (2013.01); *A63B 24/0087* (2013.01); *A63B 21/055* (2013.01); *A63B 2071/068* (2013.01); *A63B 2220/13* (2013.01); *A63B 2220/803* (2013.01); *A63B 2230/207* (2013.01); *A63B 2230/438* (2013.01)

(58) Field of Classification Search

CPC ..... A63B 21/06–21/0628; A63B 21/00076; A63B 21/4047; A63B 24/0087; A63B 21/00072; A63B 23/03516; A63B 2071/068; A63B 2230/207; A63B 2230/438; A63B 2220/803; A63B 21/055; A63B 2220/13

See application file for complete search history.

(56) References Cited

U.S. PATENT DOCUMENTS

RE31,170 E * 3/1983 Mazman ..... A63B 21/0615 482/98
4,407,495 A * 10/1983 Wilson ..... A63B 21/0615 482/138
4,509,745 A * 4/1985 Angsten ..... A63B 21/06 482/113
4,511,137 A * 4/1985 Jones ..... A63B 21/00181 482/100
4,546,971 A * 10/1985 Raasoch ..... A63B 21/063 482/100

(Continued)

*Primary Examiner* — Stephen Crow
*Assistant Examiner* — Garrett Atkinson
(74) *Attorney, Agent, or Firm* — Sheridan Ross P.C.

(57) ABSTRACT

An exercise apparatus is provided where a user selectively changes the amount of effort required to operate the machine on demand without interrupting the workout. A manual shifting process allows the user to selectively change the amount of resistance with the gravity included positioning of a resistance weight on a lever arm.

13 Claims, 4 Drawing Sheets

(56) References Cited

U.S. PATENT DOCUMENTS 4,561,656 A * 12/1985 David ..... A63B 21/0624 273/110
4,709,920 A * 12/1987 Schnell ..... A63B 21/06 482/100
4,828,255 A * 5/1989 Lahman ..... A63B 21/00047 482/142
4,863,161 A * 9/1989 Telle ..... A63B 21/00072 482/112
4,982,956 A * 1/1991 Lapcevic ..... A63B 21/00072 482/100
5,135,451 A 8/1992 Chen
5,286,243 A * 2/1994 Lapcevic ..... A63B 21/15 482/100
5,344,374 A 9/1994 Telle
5,692,997 A * 12/1997 Stearns ..... A63B 23/0211 482/100
5,788,616 A 8/1998 Polidi
5,897,022 A * 4/1999 Mann ..... A63F 7/3622 221/155
5,897,473 A * 4/1999 Koenig ..... A63B 21/0615 482/137
6,019,711 A * 2/2000 Koenig ..... A63B 21/0617 482/137
6,074,328 A * 6/2000 Johnson ..... A63B 21/0615 482/137
7,101,322 B2 * 9/2006 Carle ..... A63B 21/0615 482/100
7,278,958 B2 * 10/2007 Morgan ..... A63B 21/00072 482/121
7,374,519 B2 * 5/2008 Naidus ..... A63B 21/00072 482/137
7,976,441 B2 * 7/2011 Ellis ..... A63B 21/0615 482/114
2006/0229134 A1 * 10/2006 Briggs ..... A63F 7/2472 472/128
2009/0029835 A1 * 1/2009 Ellis ..... A63B 21/0615 482/97

* cited by examiner

EXERCISE APPARATUS WITH A USER CONTROLLED, GRAVITY OPERATED SHIFTING MECHANISM

CROSS-REFERENCE TO RELATED APPLICATIONS

This application claims priority under 35 U.S.C. §119(e) to U.S. Provisional Patent Application Ser. No. 61/907,514 filed Nov. 22, 2013 and U.S. Provisional Patent Application Ser. No. 62/074,218 filed Nov. 3, 2014, which are incorporated herein in their entirety by reference.

FIELD OF THE INVENTION

The present invention relates to exercise equipment and more specifically to exercise equipment that allows a user to vary the amount of weight or resistance against the user's efforts when performing any given lifting exercise.

BACKGROUND OF THE INVENTION

For centuries individuals have lifted heavy objects in order to increase their strength and fitness. More recently, the advent of compact weight lifting machines has enabled users to perform multiple lifting exercises on the same device. A common feature of these machines is that they enable the user to select from multiple available weights or resistances, thus allowing the user to adjust the amount of effort necessary to perform any given lifting exercise. U.S. Pat. No. 5,135,451 to Chen discloses one such lifting machine in which the resistance is provided by a stack of weights located at the back of the device, and is incorporated by reference herein in its entirety.

Although these machines provide a convenient and space-efficient means for performing multiple lifting exercises, the arrangement of these machines makes it difficult to perform certain types of lifting workouts. If a user wishes to cycle through multiple resistance levels in the course of a single set, the user must either enlist the aid of a partner to adjust the weight, or stop the workout, adjust the weight, and then resume the workout. Thus, a lifting machine which allows a user to adjust the effort necessary to perform the workout mid-set without stopping the workout and without the aid of another person is desired.

U.S. Pat. No. 5,788,616 to Polidi discloses a weight lifting machine that utilizes a user-controlled electric motor to adjust the resistance experienced by the user during the workout, and is incorporated by reference herein in its entirety. One drawback of such a machine is that it requires access to an electrical power source to operate. Additionally, electrical components can be difficult and costly to replace in the event they break down. Thus, there is a need for a user-controlled, resistance-adjusting machine that does not rely on electrical components. Furthermore, the expense associated with replacing an existing weight machine can be cost-prohibitive for both individual users as well as commercial fitness centers. Accordingly, it is desirable that any user-controlled weight adjustment device be able to attach to existing weight lifting machines.

SUMMARY OF THE INVENTION

These and other needs are addressed by the various embodiments and configurations of the present invention. Specifically, certain embodiments of this invention relate to a novel, self-contained, gravity-powered weight lifting machine that may easily replace the operating arm/lever assembly of existing weight machines, or otherwise attach to a weight machine, and that allows the user to selectively change the amount of effort required to operate the machine on demand without interrupting the workout through a simple manual shifting process.

Thus, it is one aspect of various embodiments of the present invention to provide a weight lifting device that allows a user to change the amount of effort necessary to operate the device by moving a resistance weight from one position to another position along a user-operated lever arm. It is another aspect of some embodiments of the present invention to provide device whereby the user may initiate the movement of the resistance weight along the lever arm without stopping the workout and without the aid of another person. It is yet another aspect of various embodiments of the present invention to provide a resistance weight that may accept additional weight inserts, or may be exchanged for a separate weight, allowing the user to choose smaller or larger incremental changes in required effort prior to beginning the workout.

It is another aspect of various embodiments of the present invention to provide a user the ability to engage in various fitness routines in an uninterrupted, instant manner. During interval training, a user may vary his or her workout between a high resistance or weight and low resistance or weight. Similarly during pyramid training, a user may vary the weight or resistance of an exercise apparatus such that the weight or resistance sequentially ascends or descends throughout a set or series of sets as dictated by the user. In the instance where the weight or resistance descends, the user stays in a maximum resistance zone to help maximize the user's workout. The present invention allows a user to vary the weight or resistance of an exercise apparatus during interval training, pyramid training, or any other training regimen without interruption, something not currently offered.

It is still another aspect of various embodiments of the present invention to provide a weight lifting device that is capable of operating without the aid of electrical components. The user may initiate a change in the amount of effort necessary to perform the workout by manually activating a button, lever, foot-pedal, or other mechanical switch known in the art, which in turn initiates the movement of a resistance weight from one position to another along the lever arm. It is one aspect of the present invention to provide a resistance weight with gravity-powered movement along the lever arm, wherein the resistance training is directly proportional to the positioning of the weight on the lever arm. It is yet another aspect of the present invention to ensure that the user engages the exercise apparatus through its full range of motion. The range of motion is full because the lever arm assembly must be raised or lowered to effectuate the gravity-powered movement of the resistance weight.

It is yet another aspect of the present invention to provide a self-contained device that allows a user to adjust the amount of effort necessary to perform a resistance training exercise. This device may be interconnected to a larger machine that was originally designed to operate with the device. Alternatively, the device may be selectively interconnected with virtually any moving part of an existing weight machine, whether that machine utilizes cables, weight stacks, plates, resistance bands, springs, or any other resistance device known in the art. One advantage of this embodiment is that it provides current weight machine owners and gyms with a cost-effect way to upgrade their equipment.

It is another aspect of the various embodiments of the present invention to provide a weight lifting device that enables the user to precisely and instantly control the amount of effort necessary to perform the workout. Alternatively, the amount of effort necessary to perform the workout may be controlled remotely. This aspect makes the present invention ideal for physical therapy settings, where it may be necessary for a patient or a physical therapy technician to adjust the amount of effort being exerted by the patient in the middle of the patient's workout.

It is a further aspect of some embodiments of the present invention to provide a self contained unit that fits any weight machine that enables the user to change their felt resistance on demand either manually or automatically while being operated without any electronics, without changing the machines operating characteristics, or disrupting the users form.

Some embodiments of the present invention comprise an automatic trip mechanism. The purpose of the internal automatic trip mechanism in some embodiments is to allow the user to change the amount of resistance they feel during repetitions, on demand, with no change to any aspect of their technique or form other than simply moving the operating arm slightly past the users normal "workout range of motion", (higher and lower ½" in some embodiments.) Assembly contains no electrical parts.

In one embodiment of the present invention, a substantially circular resistance weight moves from a first position to a second position along the lever arm to change the amount of force and resistance to perform the workout. In some embodiments, this substantially circular resistance weight comprises an axle gear, which is fitted into a track along the length of the lever arm. This embodiment has the advantage of providing precise control of the movement of the resistance weight along the lever arm. By providing an axle gear that has a smaller circumference than the substantially round resistance weight, the user can make use of the additional leverage inherent in this configuration to more easily move the resistance weight along the length of the lever arm in the event that the resistance weight needs to be manually reset. In some embodiments, the resistance weight may comprise a magnet proximate to a magnetic channel of the same polarity along the lever arm. This magnetic embodiment has the advantage of frictionless motion as the resistance weight travels from one position to another position along the lever arm.

In various embodiments of the present invention, a restraining device prevents the movement of the resistance weight from one position to another along the lever arm, thus preventing a change in effort necessary to perform the workout. The restraining device may be attached to the resistance weight, the lever arm, or any other structure attached to the self-contained weight lifting device. In various embodiments, the resistance weight comprises one or more stop surfaces. The stop surfaces may be an outer surface of the resistance weight; pegs, bushings, gear teeth, or any other protrusions known in the art, including holes, channels, grooves, ridges, or any other indentations known in the art. In various embodiments, the restraining device is configured to interact with the stop surfaces of the resistance weight, thus preventing the movement of the resistance weight from one position to another position along the lever arm. The weight is thus locked or secured along the lever arm for a given number of exercises performed at which time the weight is selectively moved by the user to a lever or higher resistance lever, i.e., positioning of the weight on the lever arm until another set of repetitions is completed, and the weight moved again until the exercise is completed.

In various embodiments, the user or another person controls the release of a restraining device, thus allowing the resistance weight to move along the length of the lever arm resulting in a change in the amount of effort necessary to perform the workout. In some embodiments, the user may interact with a release device. The release device may comprise a lever, button, foot pedal, or other switch known in the art. In various embodiments, the release device is interconnected to the restraining device by way of a wire, hydraulic tube, or other interconnection known in the art.

In certain embodiments, more than one resistance weight is operably interconnected to the lever arm. Multiple resistance weights allow a user to precisely control the amount of weight or resistance against the user's efforts when performing any given lifting exercise. In one embodiment, a first resistance wheel and a second resistance wheel are operably interconnected to the lever arm. In this particular embodiment the first resistance wheel weighs more than the second resistance wheel, but one skill skilled in the art will appreciate embodiments where the second resistance wheel is greater than or equal to the first resistance wheel in weight. The user may move the first resistance wheel from one position to another to create large changes in weight or resistance and set a base range. Then, the user may move the second resistance wheel from one position to another to create smaller, more incremental changes in weight or resistance as the exercise apparatus is operated as described herein.

In various embodiments, the exercise apparatus may comprise more than one release device, restraining device, or trip mechanism assembly. For example, in one embodiment the exercise apparatus comprises a first trip mechanism assembly and a second trip mechanism assembly. Activation of the first trip mechanism assembly causes a resistance wheel to move from one position to another to create large changes in weight or resistance and set a base range. Activation of the second trip mechanism assembly causes a resistance wheel to move from one position to another to create smaller, more incremental changes in weight or resistance. In further embodiments, multiple release devices, restraining devices, or trip mechanism assemblies may be used in combination with multiple resistance weights such that one or more release devices, restraining devices, and/or trip mechanism assemblies correspond to a given resistance weight. Various embodiments may include multiple manual release mechanisms to control various release devices, restraining devices, trip mechanism assemblies, and/or resistance weights.

As mentioned above, in various embodiments of the present invention a user may change the weight of a resistance wheel. In certain embodiments, a user may add standard weight plates to the resistance weight's axle to allow for greater or smaller change in weight or resistance during use of the exercise apparatus. The additional weights may be added to the axle and be disposed outside of the lever arm assembly and change position along with the resistance wheel.

One embodiment of the present invention is an exercise apparatus comprising a lever arm having a proximal end and a distal end; a pivot point positioned between the proximal end and the distal end, the lever arm rotatable about the pivot point, wherein the elevation of the distal end is selectively altered; a resistance weight operably interconnected to the lever arm and movable between a first position and a second position along the lever arm; a trip mechanism operably interconnected to the resistance weight, the trip mechanism configured to receive an input from a user, wherein upon receiving the input, the trip mechanism causes the resistance weight to move between the first position and the second position to change the distance between the resistance weight and the pivot point.

Another embodiment is a method of selectively changing the resistance of an exercise apparatus, comprising: providing a lever arm having a proximal end, a distal end, and a pivot point positioned between the proximal end and the distal end, the lever arm rotatable about the pivot point in a substantially vertical direction; providing a resistance weight operably interconnected to the lever arm and movable between a first position and a second position along the lever arm; providing a trip mechanism operably interconnected to the resistance weight, the trip mechanism configured to receive an input from a user, wherein upon receiving the input, the trip mechanism causes the resistance weight to move between the first position and the second position; sending an input to the trip mechanism to move the resistance weight and change the distance between the resistance weight and the pivot point.

Yet another embodiment is an exercise apparatus with a user-operated resistance adjustment mechanism, comprising a lever arm having a proximal end and a distal end; a pivot point positioned proximate to the proximal end, the lever arm rotatable about the pivot point; a traveling wheel movable between a first position and a second position along the lever arm, wherein the force required to lift the distal end of the lever arm can be selectively changed by a user of the apparatus, and a user-activated release assembly which selectively releases the traveling wheel to move between the first position and the second position.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about".

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE FIGURES

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1:
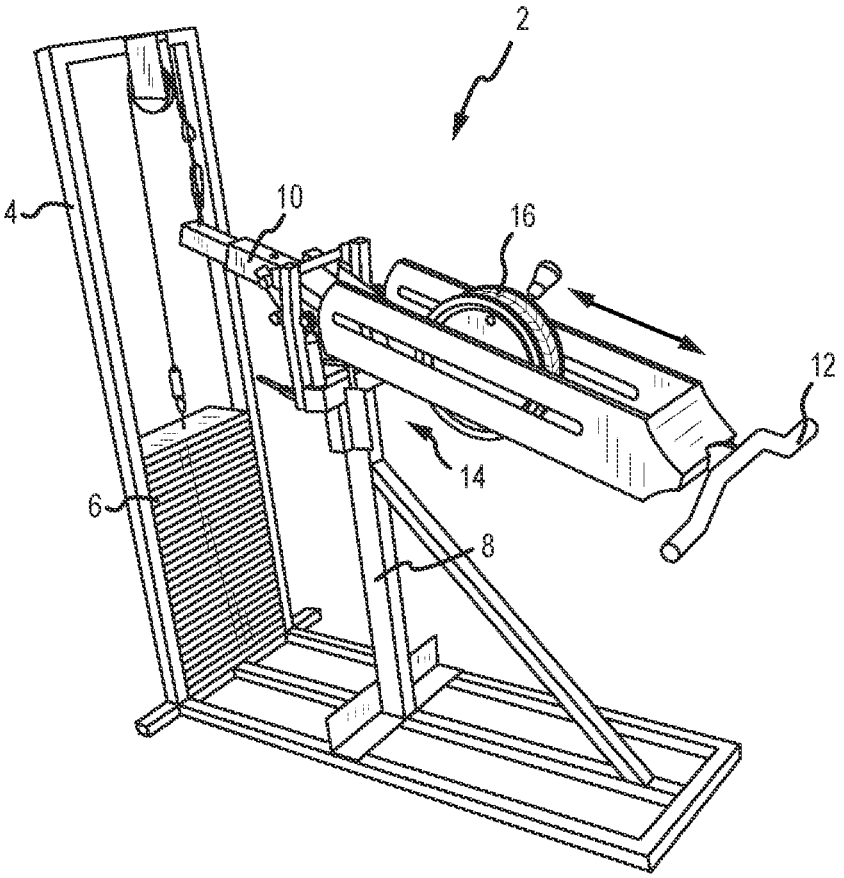
FIG. 1 is a perspective view of an embodiment of an exercise apparatus.

To assist in the understanding of the embodiments of the present invention the following list of components and associated numbering found in the drawings is provided herein:

| Component No. | Component |
|---|---|
| 2 | Exercise Apparatus |
| 4 | Frame |
| 6 | Weight Stack |
| 8 | Pedestal |
| 10 | Lever Arm |
| 12 | Handle |
| 14 | Trip Mechanism |
| 16 | Resistance Wheel |
| 18 | Gear Track |
| 20 | Cable |
| 22 | Knob |
| 24 | Cover |
| 26 | Pivot Point |
| 28 | Trip Stud |
| 30 | Trip Rod |
| 32 | Trip Lever |
| 34 | Disconnect Pawl |
| 36 | Pivot Arm |
| 38 | Latch Bar |
| 40 | Roller Bushing |
| 42 | Electronic Device |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Those of skill in the art will recognize that the following description is merely illustrative of the principles of the disclosure, which may be applied in various ways to provide many different alternative embodiments. This description is made for illustrating the general principles of the teachings of this disclosure and is not meant to limit the inventive concepts disclosed herein.

Now referring to FIG. 1, a perspective view of an exercise apparatus 2 is provided. A frame 4 provides a rigid structure for the exercise apparatus 2 where various components and assemblies may be interconnected to the frame 4. In this embodiment, a weight stack 6 comprises plates that are interconnected to the frame 4 via two guides. The plates are selectively interconnected to the guides such that the plates may traverse vertically during utilization of the exercise apparatus 2. A pin is partially disposed between individual plates, and the location of the pin determines which plates may traverse vertically during utilization of the exercise apparatus 2. Plates located above the pin may traverse vertically while the plates located below the pin remain stationary. The greater number of plates that traverse vertically, the greater the amount of weight or resistance provided against the user's efforts.

The frame 4 comprises a pedestal 8 where a lever arm 10 is disposed. The lever arm 10 has a proximal end and a distal end that comprises a handle 12 for a user to engage. The lever arm 10 interconnects to the pedestal 8 at a pivot point between the lever arm's 10 proximal and distal ends. One skilled in the art will appreciate that in some embodiments the pivot point may be disposed at one of the proximal or distal ends, or even extend beyond these ends. A cable interconnects the lever arm's proximal end to the weight stack 6 such that the cable translates the weight of the plates to the lever arm 10. A user engages the handle 12 to conduct lifting exercises. As the user moves the handle 12 and the lever arm 10, the weight stack 6 is engaged and increases the amount of effort necessary to perform a given lifting exercise. The user selects the amount of weight or resistance provided by the weight stack 6 before engaging the exercise apparatus 2 to conduct lifting exercises. In addition, a counter weight may be disposed on the lever arm 10 between the lever arm's 10 proximal end and the pivot point to further customize the amount of weight lifted by the user.

A resistance wheel 16 operably interconnected to the lever arm 10 provides additional weight against the user's efforts. The amount of weight or resistance provided by the resistance wheel 16 is variable. As the resistance wheel 16 moves away from the pivot point and further toward the distal end of the lever arm 10, the more weight or resistance is provided against the user's efforts. The resistance wheel 16 may move based on gravitational pull in some embodiments of the present invention. Gravity and other ways to move the resistance wheel 16 are described in further detail below.

The user activates a trip mechanism 14 to dictate the resistance wheel's 16 position along the lever arm 10. The user may activate the trip mechanism 14 with a variety of inputs. For example, a foot pedal may be mechanically linked to the trip mechanism 14. When a user is lifting the handle 12 and wants to increase or decrease the amount of weight, he or she may engage the foot pedal. In another example, the angle of the lever arm 10 may activate the trip mechanism 14. When the user lifts the handle 12 higher than the normal range of motion during exercise, the trip mechanism 14 is activated and the resistance wheel 16 moves closer to or further from the pivot point. One skilled in the art will appreciate a variety of inputs to activate the trip mechanism 14 including, but not limited to, voice activation, motion sensors, thermal cameras, oxygen sensors, etc.

Figure 2:
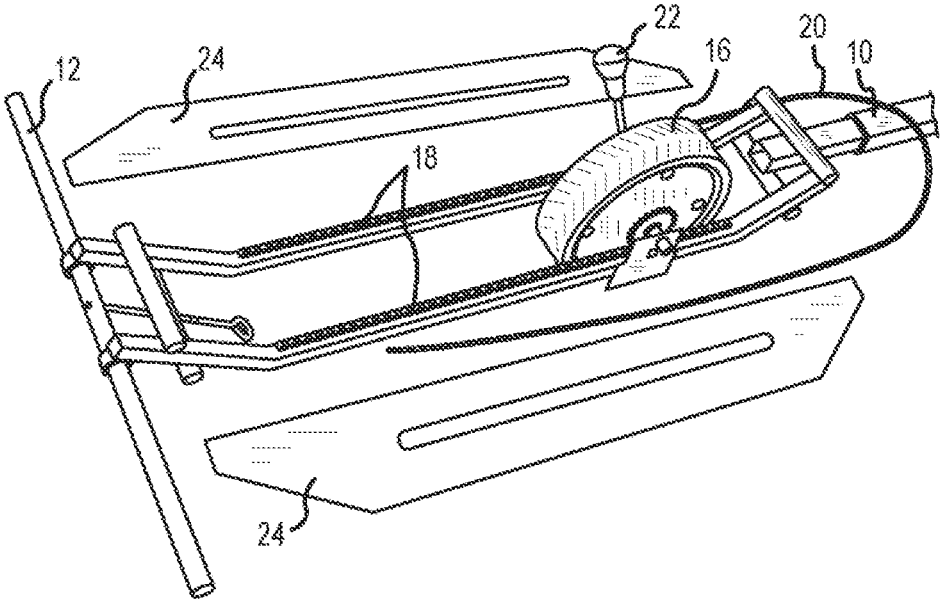
FIG. 2 is a perspective view of one end of a lever arm.

Now referring to FIG. 2, a partially disassembly view of the exercise apparatus is provided. As discussed above, a handle 12 is disposed on a distal end of the lever arm 10. The handle 12 may be a straight, tubular bar as shown in FIG. 2. In other embodiments, one skilled in the art will appreciate that the handle 12 may be any shape or handle type known in the art. Examples of the handle 12 include, but are not limited to, a bent bar, a strap with elastic properties, a rotating cable handle, a double stirrup handle, etc.

Two gear tracks 18 disposed on the lever arm 10 provide a location for the resistance wheel 16 to traverse along the longitudinal length of the lever arm 10. The resistance wheel 10 may comprise one or more gears that operably interconnect the resistance wheel 10 to the gear tracks 18 in a rack-and-pinion configuration. Other embodiments of the present invention may have gear tracks 18 that have planar surfaces and are not configured to receive gear teeth from the resistance wheel 10. Instead, embodiments of the present invention may have a resistance wheel 10 that moves along gear tracks 18 using wheels, planar surfaces, bearings, or any other position translating means known in the art. Further, in some embodiments the exercise apparatus may not have gear tracks 18. In the embodiment depicted in FIG. 2, stops are disposed at either end of the gear tracks 18 to limit the resistance wheel's 16 domain of travel along the lever arm 10.

Covers 24 may be selectively interconnected to each side of the lever arm 10. These covers 24 protect the user against the resistance wheel 16 as it moves along the lever arm 10. Further, the covers 24 may comprise markings that indicate how much more weight or resistance is provided against the user's lifting motion.

Figure 3:
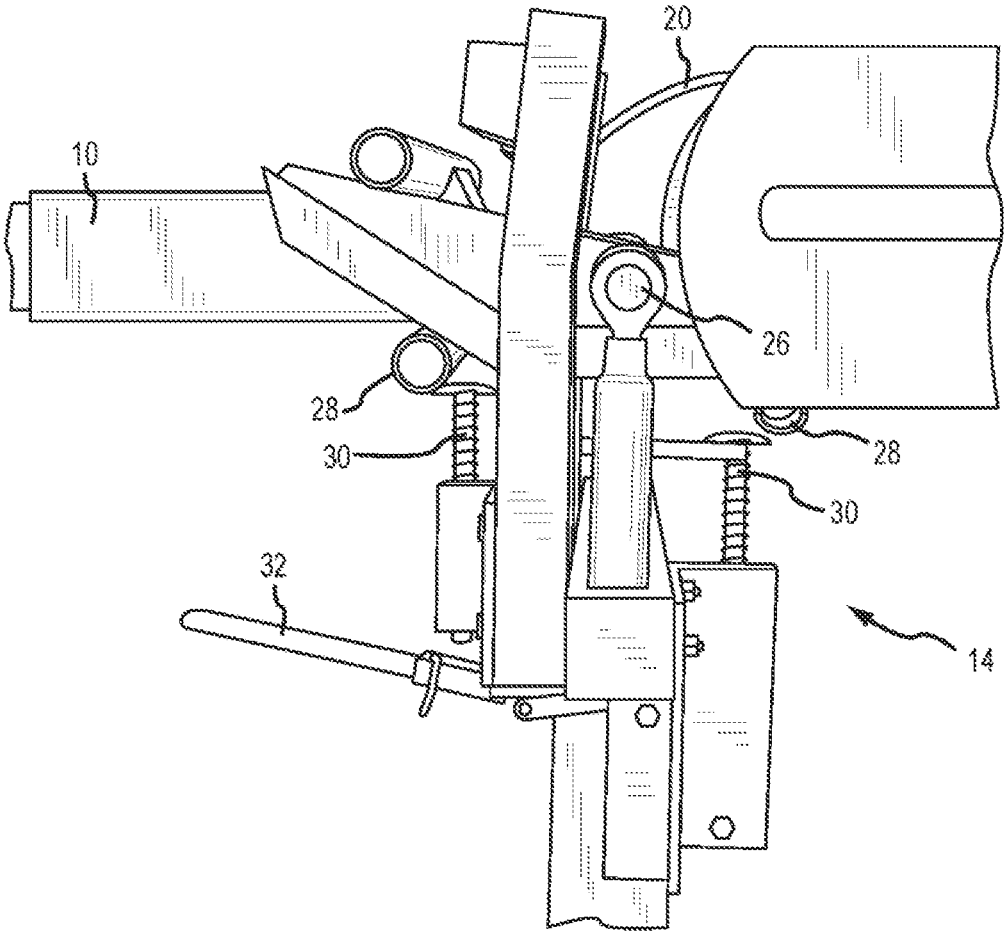
FIG. 3 is an elevation view of a trip mechanism.

A cable 20 extends from the resistance wheel 16 and operably interconnects the resistance wheel 16 to a trip mechanism 14 shown in FIG. 3. When the user activates the trip mechanism 14 with an input, the trip mechanism 14 actuates or pulls the cable 20 which causes the resistance wheel 16 to change positions. A knob 22 is also provided on the resistance wheel 16 so that a user may manually vary the position of the resistance wheel 16 along the lever arm 10 and gear tracks 18.

Now referring to FIG. 3, a trip mechanism 14 according to one embodiment of the present invention is provided. The lever arm 10 rotates about a pivot point 26. The trip mechanism 14 is disposed underneath the lever arm 10, and the lever arm 10 comprises two trip studs 28 to engage two trip rods 30 of the trip mechanism 14. One trip stud 28 is positioned on the proximal side of the pivot point 26, and one trip stud 28 is positioned on the distal side of the pivot point 26 (i.e., closer to the user and the handle). Each trip rod 30 is spring-biased toward the corresponding trip stud 28. As a user engages the lever arm 10 and rotates the lever arm 10 about the pivot point 26, the trip studs 28 deflect the trip rods 30. During the normal lifting range of the exercise, the deflecting trip rods 30 are of no consequence.

However, if a user lifts the lever arm's 10 distal end higher or lower than the normal lifting range, then the trip rods 30 engage a trip lever 32 to activate the trip mechanism 14. Thus, the rotational position of the lever arm 10 is the input to activate the trip mechanism 14, and there are two rotational positions that activate the trip mechanism 14. When the user raises the lever arm's 10 distal end higher than the normal lifting range, then the trip stud 28 on the proximal side of the pivot point 26 engages the associated trip rod 30, which in turn engages the trip lever 32. Similarly, when the user lowers the lever arm's 10 distal end lower than the normal lifting range, then the trip stud 28 on the distal side of the pivot point 26 engages the associated trip rod 30, which in turn engages the trip lever 32. One skilled in the art will appreciate that a user may adjust the trip studs 28 and trip rods 30 to vary what is a normal range of motion during an exercise.

Once the trip lever 32 is engaged by one of the trip rods 30, the trip lever 32 actuates or pulls the cable 20. As discussed in further detail below, the physical pull of the cable 20 causes the resistance wheel 16 to move along the longitudinal length of the lever arm 10. In addition, the trip lever 32 extends outward such that a user may manually engage the trip lever 32 and cause the resistance wheel to move along the lever arm 10.

In the embodiment depicted in FIG. 3, the resistance wheel 16 moves along the length of the lever arm 10 based on gravitational pull. In other words the resistance wheel 16 has a locked state where the resistance wheel's 16 position is fixed relative to the lever arm 10, and the resistance wheel 16 has an unlocked state where the resistance wheel 16 is free to travel along the lever arm 10. Therefore, when the user raises the lever arm's 10 distal end such that proximal trip stud 28 engages the associated trip rod 30, the resistance wheel 16 moves toward the pivot point 26 to decrease the amount of effort needed to lift the lever arm's 10 distal end. Similarly, when the user lowers the lever arm's 10 distal end such that the distal trip stud 28 engages the associated trip rod 30, the resistance wheel 16 moves away from the pivot point 26 to increase the amount of effort needed to lift the lever arm's 10 distal end. Moving the resistance wheel 16 based on gravitational pull allows a user to maintain a grip on the handle 12, foot position, form, balance, rhythm, etc.

Some embodiments of the present invention may include a ratchet mechanism operably interconnected to the trip mechanism 14 wherein the ratchet serves as the input to activate the trip mechanism 14. The ratchet mechanism may be configured to activate the trip mechanism 14 after a predetermined number of repetitions. For example, the ratchet mechanism may activate the trip mechanism 14 every 2nd, 3rd, 4th, etc. repetition to cause the resistance wheel 16 to change positions along the lever arm 10.

Figure 4:
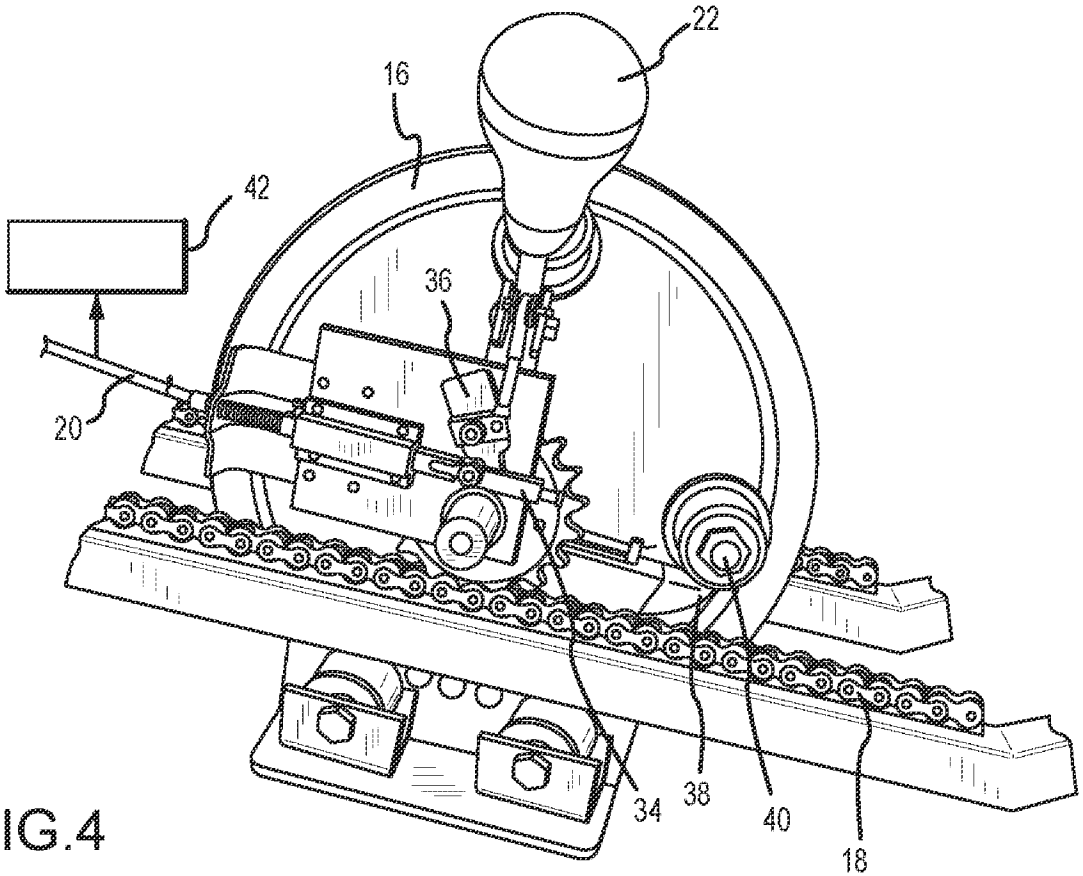
FIG. 4 is an elevation view of a resistance wheel.

Now referring to FIG. 4, a resistance wheel 16 and associated components are provided. Extending outward to either side of the resistance wheel 16 is an axle and gears, which operably interconnect to the gear tracks 18 such that the resistance wheel 16 may vary its position along the lever arm 10.

Two latch bars 38 and four roller bushings 40 are disposed on the resistance wheel 16, and these elements dictate whether the resistance wheel 16 is in a locked state (unable to move along the lever arm 10) or unlocked state (able to move along the lever arm 10). When the latch bars 38 extend outward from a housing and contact one or more of the roller bushings 40, then the resistance wheel is in a locked state. When the latch bars retract within the housing, then the roller bushings 40 do not prevent the resistance wheel 16 from rotating, and the resistance wheel 16 is in an unlocked state.

The cable 20 is actuated or pulled when the trip mechanism 14 is activated, and the latch bars 38 retract into the housing which allows the resistance wheel 16 move along the lever arm 10 and vary its position relative to the pivot point. The cable 20 is interconnected to a disconnect pawl 34. When the cable 20 pulls the disconnect pawl 34, the disconnect pawl 34 rotates a pivot arm 36 which in turn pulls a knob lever. The knob lever pulls a wire which is interconnected to the latch bars 38, and the latch bars 38 retract into the housing. As mentioned above, a user may pull on the knob 22 which is disposed on the end of the knob lever to manually retract the latch bars 38 within the housing and place the resistance wheel 16 in an unlocked state. Once the cable 20 pulls the disconnect pawl 34 a certain distance, the disconnect pawl releases the pivot arm 34, and the latch bars 38 retract back into the housing.

One skilled in the art will appreciate that other embodiments may include electronic roller bushings 40 or other electronic components. In one embodiment, the trip mechanism 14 sends an electronic signal to a solenoid roller bushing 40 that extends to contact a latch bar 38 in an extended state or retract into the resistance wheel 16 in an unextended state. Similarly, the solenoid may be disposed proximate to the resistance wheel 16 and selectively insert an element into recesses or apertures in the resistance wheel 16 to dictate the position of the resistance wheel 16 along the lever arm 10.

When the user activates the trip mechanism 14 and the resistance wheel 16 is in an unlocked state, the resistance wheel 14 may move along the lever arm 10 according to a variety of parameters. In the embodiment depicted in FIG. 4, the parameter is a predetermined distance. Since there are four roller bushings 40 evenly spaced on the resistance wheel 16, one cycle of trip mechanism 14 activation results in a ¼ rotation of the resistance wheel 16. Because the resistance wheel's 16 gears operably interconnect to the gear tracks 18, the resistance wheel 16 moves along the lever arm 10 by a predetermined distance of the gear diameter times $\pi/4$. Therefore, variation of the gear diameter and/or the number of roller bushings 40 affects the predetermined distance that the resistance wheel 16 travels.

In some embodiments, the gear diameter may be between approximately 0.5 inches and 24 inches. In various embodiments, the gear diameter may be between approximately 3 inches and 12 inches. In other embodiments, the gear diameter may be any one of 1, 2, 3, 4, 5, 6, 7, and 8 inches.

In some embodiments, the number of roller bushings 40 is between 1 and 16. In various embodiments, the number of roller bushings 40 is between 2 and 8. In other embodiments, the number of roller bushings 40 may be any one of 4, 6, and 8. One skilled in the art will appreciate that the roller bushings 40 are not necessarily evenly spaced about the resistance wheel 16.

In the embodiments described above, the trip mechanism 14 is physical in nature where the position of various linkages activates the trip mechanism 14 and actuates or pulls the cable 20. In various embodiments, the trip mechanism 14 may be an electronic device 42, and there may be a variety of inputs that activate the electronic device 42. In one embodiment, the electronic device 42 is an electric linear actuator that is in electronic communication with a sensor. The sensor may detect a particular motion of the user, a voice command from the user, a position of the lever arm 10, oxygen content, an infrared signature, or any other quality commonly detected by sensors. The sensor may activate the electronic device 42 to actuate or pull the cable 20 to place the resistance wheel 16 in an unlocked state.

Next, some embodiments of the present invention my employ a different type of resistance wheel 16 that does not move along the lever arm 10 based on gravitational pull. The resistance wheel's 16 motion may be powered by electric linear actuators, pneumatics, hydraulics, magnetism, or any other power sources commonly known in the art.

This also means that resistance wheel 14 may move along the lever arm 10 according to parameters that do not include the number of roller bushings 40 or gear diameter. For example, the resistance wheel 16 may be placed in an unlocked state for a predetermined time. In another example, the resistance wheel 16 may move along the lever arm 10 in variable distance or time increments. In addition, the resistance wheel 16 may continuously move along the lever arm 10 in an unlocked state such that the resistance or weight experienced by the user is continuously increasing or decreasing during the particular exercise.

The resistance wheel 16 may also not be in the shape of a wheel. In alternative embodiments, the resistance wheel 16 may be a mass of any shape that moves away from or closer to the pivot point to vary the resistance or weight experienced by the user.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

The invention claimed is:

1. A gravity-assisted, selectively adjustable exercise apparatus, comprising:

a lever arm having a proximal end and a distal end;

a pivot point positioned between said proximal end and said distal end, said lever arm rotates a predetermined angle about said pivot point, wherein the elevation of said distal end is selectively altered;

a resistance weight operably interconnected to said lever arm, wherein said resistance weight is movable between a first position and a second position along said lever arm when said resistant weight is in an unlocked state, and said resistance weight is immovable between said first position and said second position in a locked state, and wherein said resistance weight is movable away from said pivot point and toward said pivot point based on said predetermined angle and gravitational pull; and a trip mechanism operably interconnected to said resistance weight, wherein upon receiving an input from a user during an exercise, said trip mechanism causes said resistance weight to move between said first position and said second position to change the distance between said resistance weight and said pivot point.

2. The exercise apparatus of claim 1, wherein said resistance weight is a wheel that moves between said first position and said second position based on gravity.

3. The exercise apparatus of claim 1, wherein said input is said predetermined angle of rotation of said lever arm about said pivot point.

4. The exercise apparatus of claim 1, wherein said trip mechanism comprises:

a trip rod, wherein said trip rod is spring-biased toward said lever arm;

a trip lever, wherein said trip rod is disposed between said lever arm and said trip lever;

a cable operably interconnected to said trip lever;

wherein when said lever arm rotates said predetermined angle about said pivot point, said trip rod overcomes said spring bias and contacts said trip lever, and wherein said trip lever pulls said cable to cause said resistance weight to move between said first position and said second position.

5. The exercise apparatus of claim 1 further comprising a resistance weight assembly, said resistance weight assembly comprising:

a disconnect pawl operably interconnected to said trip mechanism;

a rotatable pivot arm disposed proximate to said disconnect pawl;

a latch bar operably interconnected to said rotatable pivot arm, wherein said latch bar has an extended state where said latch bar contacts at least one roller bushing disposed on said resistance weight and an unextended state where said latch bar does not contact said at least one roller bushing;

wherein said trip mechanism, upon receiving said input, pulls said disconnect pawl to rotate said pivot arm, and wherein rotation of said pivot arm causes said latch bar to change from said extended state to said unextended state, which causes said resistance weight to move between said first position and said second position.

6. The exercise apparatus of claim 1, wherein said proximal end of said lever arm is operably interconnected to a weight stack.

7. The exercise apparatus of claim 1, wherein said distal end of said lever is operably interconnected to at least one of a handlebar and a handgrip.

8. The exercise apparatus of claim 1, wherein said trip mechanism is at least one of a foot pedal, a hand lever, and an electronic device that pulls a cable which causes said resistance weight to travel between said first position and said second position.

9. The exercise apparatus of claim 1, said trip mechanism further comprises:

a first trip rod positioned on a proximal side of said pivot point, wherein when said distal end of said lever arm is higher than a normal lifting range, said first trip rod causes said resistance weight to move between said first position and said second position; and a second trip rod positioned on a distal side of said pivot point, wherein when said distal end of said lever arm is lower than said normal lifting range, said first trip rod causes said resistance weight to move between said first position and said second position.

10. An exercise apparatus with a user-operated resistance adjustment mechanism, comprising:

a lever arm having a proximal end and a distal end;

a pivot point positioned proximate to said proximal end, said lever arm rotatable about said pivot point;

a traveling wheel rollable between a first position and a second position along said lever arm, wherein a force required to lift said distal end of said lever arm can be selectively changed by a user of said apparatus, wherein said traveling wheel is configured to roll away from said pivot point and toward said pivot point based on gravitational pull;

a user-activated release assembly which selectively releases said traveling wheel to roll between said first position and said second position; and a trip mechanism operably interconnected to the release assembly, wherein said trip mechanism is activated based on an elevation of said distal end of said lever arm, and said trip mechanism causes said release assembly to selectively release said traveling wheel.

11. The exercise apparatus of claim 10, wherein said release assembly comprises:

a disconnect pawl;

a rotatable pivot arm disposed proximate to said disconnect pawl;

a latch bar operably interconnected to said rotatable pivot arm, wherein said latch bar has an extended state where said latch bar contacts at least one roller bushing disposed on said traveling wheel and an unextended state where said latch bar does not contact said at least one roller bushing.

12. The exercise apparatus of claim 10, wherein said traveling wheel moves between said first position and said second position and toward said pivot point when said distal end of said lever arm is higher than a normal lifting range.

13. The exercise apparatus of claim 10, wherein said traveling wheel moves between said first position and said second position away from said pivot point when said distal end of said lever arm is lower than a normal lifting range.

* * * * *